United States Patent [19]

Cullick et al.

[11] Patent Number: 5,016,712

[45] Date of Patent: May 21, 1991

[54] METHOD AND APPARATUS FOR LOCATING SOLVENT INJECTION APPARATUS WITHIN A NATURAL GAS WELLBORE

[75] Inventors: Alvin S. Cullick; Robert E. Roach, both of Dallas, Tex.

[73] Assignee: Mobil Oil Corporation, Fairfax, Va.

[21] Appl. No.: 489,111

[22] Filed: Mar. 6, 1990

[51] Int. Cl.[5] ..... F21B 47/06; F21B 47/09; F21B 47/08

[52] U.S. Cl. ..... 166/250; 166/64; 166/255; 166/304; 166/310; 166/371; 73/151; 436/177

[58] Field of Search ..... 166/250, 254, 255, 264, 166/265, 267, 304, 310, 371, 75.1, 64; 73/151; 436/177, 178, 147, 143

[56] References Cited

U.S. PATENT DOCUMENTS

| | | | |
|---|---|---|---|
| 2,690,814 | 10/1954 | Reid | 585/15 X |
| 2,943,124 | 6/1960 | Wilson | 585/15 |
| 3,819,742 | 6/1974 | Brun | 585/818 |
| 4,857,078 | 8/1989 | Watler | 585/818 X |

OTHER PUBLICATIONS

Fort, Jr., R. C., The Chemistry of Diamond Molecules, Marcel Dekker, 1976, King, W. J., "Operating Problems in the Hanlan Swan Hills Gas Field", Society of Petroleum Engineers, SPE Gas Technology Symposium, Dallas, Tex., 6/68.

*Primary Examiner*—George A. Suchfield
*Attorney, Agent, or Firm*—Alexander J. McKillop; Charles J. Speciale; Robert B. Furr, Jr.

[57] ABSTRACT

A method and apparatus are provided for locating a solvent injection apparatus within a natural gas wellbore to reduce the deposition of hydrocarbonaceous solids which are at least partially soluble in the solvent.

4 Claims, 2 Drawing Sheets

METHOD AND APPARATUS FOR LOCATING SOLVENT INJECTION APPARATUS WITHIN A NATURAL GAS WELLBORE

FIELD OF THE INVENTION

The present invention provides a method and apparatus for determining solids precipitation from a produced natural gas stream as a function of temperature and pressure. More particularly, the invention provides a method and apparatus for determining the optimum downhole solvent injection point to minimize solids deposition in both the downstream natural gas processing equipment as well as in the producing well.

BACKGROUND OF THE INVENTION

In many cases, the production of natural gas is complicated by the presence of certain heavy hydrocarbons in the subterranean formation in which the gas is found. Under conditions prevailing in the subterranean reservoirs, the heavy hydrocarbons may be partially dissolved in the compressed gas or finely divided in a liquid phase. The decrease in temperature and pressure attendant to the upward flow of gas as it is produced to the surface result in the separation of solid hydrocarbonaceous material from the gas. Such solid hydrocarbons may form in certain critical places such as on the interior wall of the production string, thus restricting or actually plugging the flow passageway.

Various processes have been developed to prevent the formation of such precipitates or to remove them once they have formed. These include mechanical removal of the deposits and the batchwise or continuous injection of a suitable solvent. Recovery of one such class of heavy hydrocarbons, i.e. diamondoid materials, from natural gas is detailed in commonly assigned copending U.S. patent application Ser. No. 405,119, filed Sept. 7, 1989, now U.S. Pat. No. 4,952,748 which is a continuation of U.S. Pat. No. 358,758, filed May 26, 1989, now abandoned, as well as U.S. patent applications Ser. No. 358,759, now U.S. Pat. Nos. 4,952,747, 358,760, now U.S. Pat. Nos. 4,952,749, and 358,761, all filed May 26, 1989. The text of these U.S. Patent Applications is incorporated herein by reference.

Certain hydrocarbonaceous streams, for example certain natural gas streams, contain a small proportion of diamondoid compounds. These high boiling, saturated, three-dimensional polycyclic organics are illustrated by adamantane, diamantane, triamantane and various side chain substituted homologues, particularly the methyl derivatives. These compounds have high melting points and high vapor pressures for their molecular weights and have recently been found to cause problems during production and refining of hydrocarbonaceous minerals, particularly natural gas, by condensing out and solidifying, thereby clogging pipes and other pieces of equipment. For a survey of the chemistry of diamondoid compounds, see Fort, Jr., Raymond C., *The Chemistry of Diamond Molecules,* Marcel Dekker, 1976.

In recent times, new sources of hydrocarbons have been brought into production which, for some unknown reason, have substantially larger concentrations of diamondoid compounds. Whereas in the past, the amount of diamondoid compounds has been too small to cause operational problems such as production cooler plugging, now these compounds represent both a larger problem and a larger opportunity. The presence of diamondoid compounds in natural gas has been found to cause plugging in the process equipment requiring costly maintenance downtime to remove. On the other hand, these very compounds which can deleteriously affect the profitability of natural gas production are themselves valuable products.

SUMMARY OF THE INVENTION

The present invention provides a method and apparatus for determining the temperature and pressure conditions under which solid hydrocarbonaceous materials precipitate from a produced natural gas stream.

More specifically, the invention provides a method for locating a solvent injection apparatus within a natural gas wellbore to reduce the deposition of hydrocarbonaceous solids which are at least partially soluble in the solvent. The solvent injection apparatus locating process comprises the steps of:

(a) estimating temperature and pressure profiles at flow conditions through the depth of the natural gas wellbore over the production life of a production natural gas well;

(b) withdrawing a sample stream from the production natural gas well;

(c) depressuring the withdrawn natural gas sample stream of step (b) to a selected pressure within the natural gas wellbore pressure range estimated in step (a);

(d) providing a solid nonporous surface maintained under conditions of substantially constant temperature selected from the range of estimated natural gas wellbore temperatures determined in step (a);

(e) flowing the depressured natural gas sample of step (c) in contact with the solid nonporous surface of step (d);

(d) measuring the quantity of natural gas contacted by said solid surface;

(e) measuring the quantity of precipitate formed on said solid surface.

The invention provides in its apparatus aspects, a device for measuring the precipitation of solid hydrocarbonaceous materials from a natural gas stream under selected conditions of temperature and pressure comprising:

(a) a valved sample conduit for withdrawing a sample stream from a production natural gas well;

(b) a pressure control valve in the sample conduit for depressuring the withdrawn natural gas stream to a preselected pressure;

(c) heating means for controlling the temperature of the valved sample conduit and the pressure control valve;

(d) a precipitate collection vessel downstream from the pressure control valve, the precipitate collection vessel being operatively connected to the valved sample conduit;

(e) means for maintaining the precipitate collection vessel at a constant preselected temperature;

(f) a metallic surface within the precipitate collection vessel for collecting hydrocarbonaceous precipitate from the depressured natural gas stream; and (g) a differential pressure indicator connected in parallel with the precipitate collection vessel.

DETAILED DESCRIPTION OF THE PREFERRED EMBODIMENT

The present invention provides a method for determining the optimum longitudinal placement of a solvent injection apparatus within wellbores producing natural gas containing certain heavy hydrocarbonaceous materials which tend to form solid precipitate deposits when the produced natural gas is cooled below the subterranean reservoir temperature. The invention also includes an apparatus for precipitating solid hydrocarbons from a natural gas stream under controlled variable conditions of temperature and pressure. The method and apparatus further isolate these precipitated solid hydrocarbons for laboratory analysis.

Figure 1:
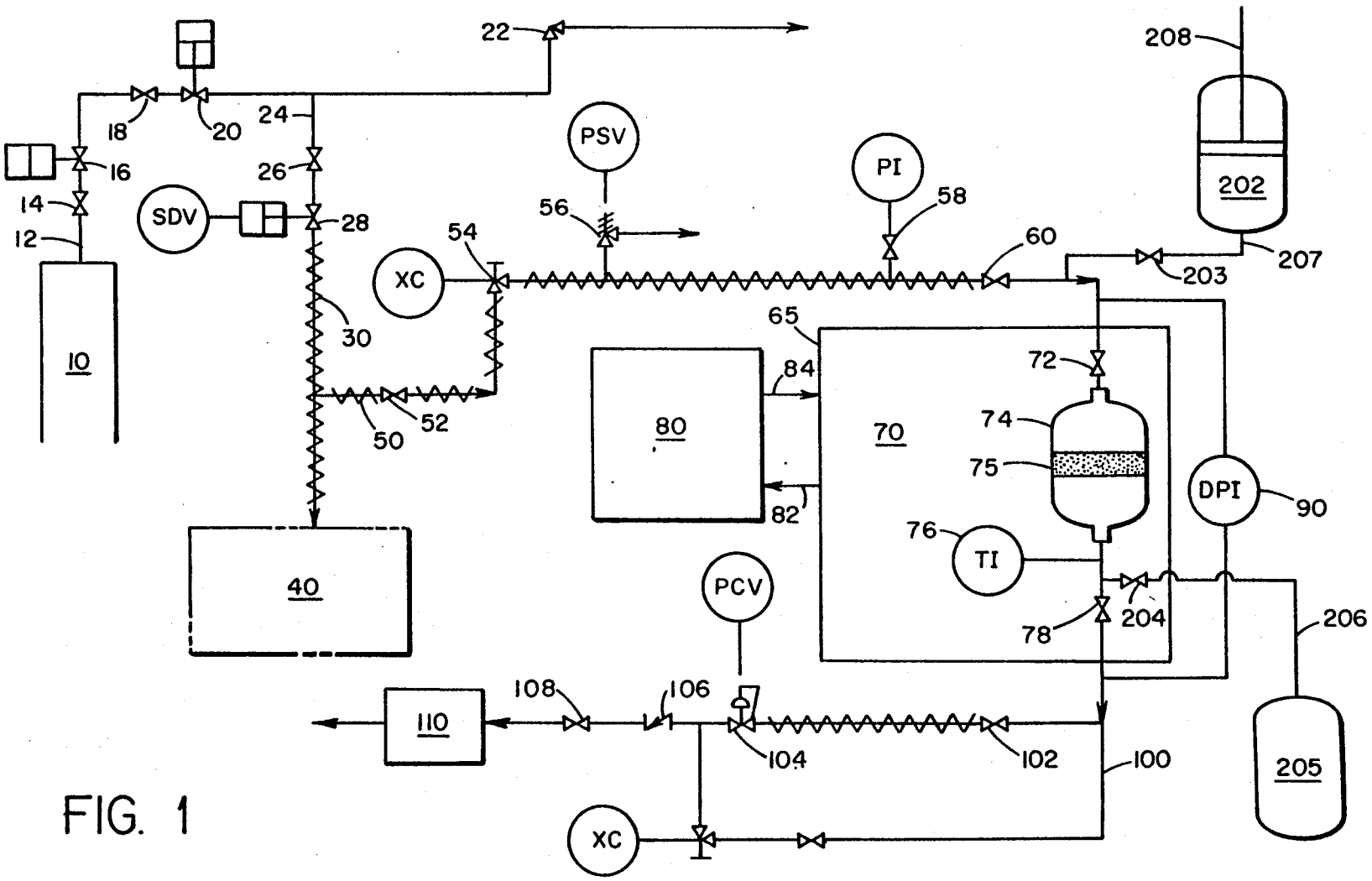
FIG. 1 is a simplified schematic diagram illustrating the major processing steps of the present invention.

Referring now to FIG. 1, natural gas containing heavy hydrocarbonaceous fractions is withdrawn from wellhead 10 through line 12 which is fitted with block valves 14 and 18 as well as shutdown valves 16 and 20. Line 12 contains a pressure control valve 22, commonly called a choke, which decreases the produced gas pressure from between about 1,200 and about 4,000 psig to about 1,100 psig for further processing.

A sample stream of natural gas is drawn off line 12 through sample line 24 between shutdown valve 20 and choke 22. Sample line 24 is equipped with block valve 26 and shutdown valve 28 so that the testing apparatus downstream from block valve 26 may be effectively isolated from the natural gas production flow in line 12. The flow through sample line 24 may optionally be split to provide a primary sample stream flowing through line 50 and a secondary sample stream flowing through sample line 24 to analyzer 40 for compositional analysis, for example on-line chromatography. Sample line 24 and line 50 are heat traced with suitable heat tracing 30, e.g. stream or electric heat tracing to prevent precipitation of hydrocarbonaceous solids or ice formation due to Joule-Thompson cooling.

The natural gas sample stream flows through line 50 which is equipped with block valve 52 and pressure control valve 54. The pressure upstream from pressure control valve 54 is essentially equal to that of the produced natural gas in line 12. Pressure control valve 54 is set to decrease the pressure downstream of the control valve to a particular test pressure between about 1,000 and 2,400 psig.

Pressure safety valve 56 vents natural gas to a low-pressure flare system (not shown) if the pressure downstream from pressure control valve 54 exceeds about 3000 psig. Pressure indicator 58 shows the line pressure downstream from control valve 54.

The natural gas sample stream flows through block valve 60 and enters the controlled temperature precipitator 70. Controlled temperature precipitator 70 comprises a nonporous solid surface in indirect contact with a constant temperature heat transfer medium such as a heat transfer oil. The natural gas sample stream flows across the solid surface precipitating heavy hydrcarbonaceous materials which crystallize on the solid surface.

The solid nonporous surface is preferably a metallic surface, which preferably comprises the inner walls of a vessel and a sintered metal filter contained therein. Porous surfaces such as those presented by molecular sieves are not preferred for use in the present invention, as they have the potential to sorb hydrocarbonaceous materials which are liquid at the conditions maintained within the controlled temperature precipitator. The term "nonporous" as used herein refers to a surface which contains essentially no aperatures for sorbing hydrocarbonaceous molecules. Thus a sintered metal filter, while containing macro pores defined by sintered metal particles, is nonporous within the meaning of the term as presently defined because the sintered metal filter exhibits no measurable sorption activity as a molecular sieve. One example of a suitable filter is a Swagelok brand filter, manufactured by Swagelok, Inc. of Solon, Ohio.

Examples of suitable materials of construction for sintered metal filters include alloys which resist attack under a broad range of temperature conditions in sulfur, mercaptan and $H_2S$-containing atmospheres. Suitable alloys include many of the Monel brand and Hastelloy brand nickel-containing alloys such as Monel alloy 400 as well as Hastelloy C276. It is to be understood, however, that materials selection for sulfur-containing (sour) gas processing is a well established art and that the choice of particular solid material used for collecting the precipitated hydrocarbonaceous solids is not critical except to the extent that it meets the requirements of resisting corrosive attack and favoring crystallization of solid precipitate rather than sorption of liquid hydrocarbons.

In a preferred embodiment schematically illustrated in the Figure, the natural gas sample stream enters controlled temperature precipitator 70 through line 50, passes through block valve 72 and enters filtration vessel 74. Filtration vessel 74 is traversed by a sintered metal filter 75 as described above. Filtration vessel 74 is immersed in a heat transfer fluid bath which is maintained at a constant temperature from about 40° to about 240° F., more typically from about 100° to about 240° F. The heat transfer fluid bath is contained within an insulated box 65, which may optionally be fitted with a lid to limit heat transfer to the surrounding atmosphere. The heat transfer fluid may be an suitable fluid such as a mixture of ethylene glycol and water, a purified middle distillate cut from a crude oil, or a hydrocarbon liquid such as Mobiltherm brand or Dowtherm brand heat transfer liquids.

The heat transfer fluid is preferably circulated through a temperature control unit 80 which provides either heating or cooling as is necessary to maintain the selected temperature within filtration vessel 74 measured at temperature indicator 76 positioned in line 50 downstream of filtration vessel 74. Heat transfer fluid is withdrawn from insulated box 65 through line 82 and charged to temperature control unit 80. The fluid is then heated or cooled as necessary and returned to insulated box 65 via line 84. Methods for maintaining a constant temperature bath are well known to those skilled in the art of chemical engineering and any suitable commercially available constant temperature bath apparatus may be adapted for use in conjunction with the present invention. A particularly preferred constant temperature bath apparatus is the Neslab Instruments model RTE 100 manufactured by the Neslab Instruments Company of Newington, N.H.. As an alternative means of heating, heater coils can be mounted inside vessel 70 and controlled by a temperature controller, such as the Watlow brand controller.

Controlled temperature precipitator 70 is fitted with a differential pressure indicator 90 which measures gas pressure drop across the precipitator. At startup, gas pressure drops approximately 0.1 to 1 psi across the clean filter 75. As the filter 75 accumulates precipitate, pressure drop may increase steadily until the sampling procedure is terminated at a pressure drop of approximately 150 psig. Alternatively, the sampling procedure may be terminated with a lower pressure drop because a small amount of precipitate can be detected by the present sampling procedure, even though such a small amount may not produce an increase in pressure drop.

The natural gas sample stream flows out of controlled temperature precipitator 70 through line 100 which is fitted with block valve 102 and pressure control valve 104. The pressure in line 100 drops to approximately 3 psig downstream of pressure control valve 104. The gas continues through line 100 across check valve 106 and block valve 108, and flows through a gas volume metering device 110. One preferred gas metering device is a dry test meter manufactured by Singer Instruments of Philadelphia, Pa., which can quantify gas flows within the range of 0.05 to 50 liters per minute. The gas is then exhausted to a low pressure flare header (not shown).

At termination of the sampling procedure, block valve 26 is shut to prevent further flow from well 10. The pressure in the sampling lines is then released by opening valves 109 and 102 to allow the gas to vent to the flare, leaving the solid collected in vessel 74.

The solid is collected and removed from the filter 75 by washing with a solvent. The solvent stored in vessel 202 is displaced by means of a piston 208 positioned in vessel 202. The piston 208 may be moved by compressed gas, such as nitrogen or air. The solvent passes through line 207 and valve 203 to vessel 74 and filter 75. It then is collected through valve 204 and line 206 into sample bottle 205. The solvent is a light organic liquid which completely dissolves the solid collected in vessel 74. Examples of such solvents include carbon disulfide, xylene, cyclohexane, and methylene chloride.

The mass of solid dissolved in the solvent is then determined by quantitative gas chromatography.

METHOD FOR LOCATING A SOLVENT INJECTION NOZZLE

The invention further provides a method for locating a solvent injection nozzle within a producing natural gas well to mitigate the underisable deposition of solid hydrocarbonaceous materials within the wellbore as well as in downstream processing equipment such as a natural gas production cooler.

Both pressure and temperature of the natural gas withdrawn from the subterranean reservoir decrease as the stream flows upwardly to the wellhead through the wellbore. Thus as the stream rises to the surface, conditions become increasingly favorable for the precipitation of heavy hydrocarbonaceous materials from the natural gas stream. Further, as natural gas is produced and withdrawn from the subterranean reservoir, pressure and temperature decrease within the reservoir, thus promoting precipitation of solids within the wellbore.

The initial step in the locating method includes logging temperature and pressure profiles for wellbores of similar depth, pressure and temperature to provide a basis for estimating the temperature profile across the length of the subject wellbore Alternatively, the profile can be estimated by numerical techniques well known to those skilled in the art with prior measurement of reservoir temperature and pressure, surface temperature and pressure, and gas flowrate.

The natural gas stream produced from the subject well is then sampled and the sample stream is depressured under controlled temperature conditions to assure that no substantial precipitation of solid hydrocarbonaceous materials occurs in the sample transfer lines. The depressured natural gas sample stream is then charged to a controlled temperature precipitator which collects solid hydrocarbons in a filtration vessel containing a sintered metal filter as described above. When the pressure drop across the filtration vessel indicates significant reduction in open area across the sintered metal filter, the sample stream is shut off and the total natural gas flow through the precipitation vessel is recorded. As noted above, however, if small quantities of solids are being collected, the sample stream flow may be shut off before any measurable pressure drop increase is noted. Thus very small quantities of solids can be detected by the sampling procedure even though the quantity is insufficient to cause any measurable increase in pressure drop. The sample line and the sintered metal filter and the precipitation vessel are rinsed with a solvent which readily dissolves the deposited solid hydrocarbonaceous material, for example adamantane, diamantane, or wax. The enriched solvent is then returned to the laboratory for chromatographic analysis.

The temperature control set points for the constant temperature bath as well as for the pressure control valve are changed to a second set of selected conditions within the range estimated for the producing wellbore. The test run is repeated and the extent of hydrocarbonaceous solids deposition is correlated as a function of temperature and pressure. The rate of hydrocarbonaceous solids deposition is then defined as a function of natural gas temperature and pressure for the well under examination. From these data, the optimum solvent injection depth may be determined by correlating the calculated solids deposition rates with the estimated temperature and pressure conditions of the subject wellbore during its producing lifespan. The solvent injection apparatus is then located within the wellbore at a depth below that required to prevent blockage due to deposition of hydrocarbonaceous solids.

EXAMPLE

Figure 2:
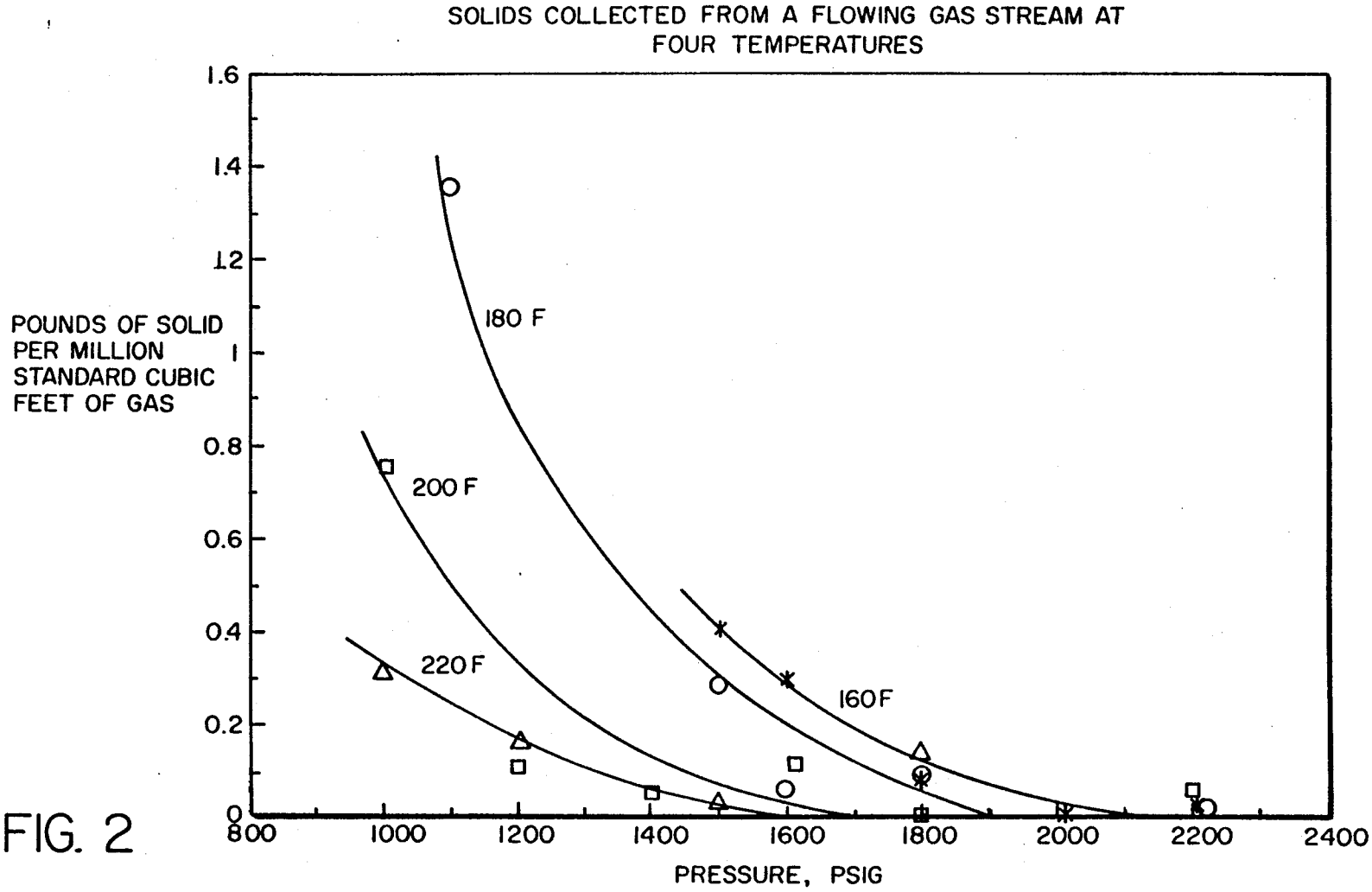
FIG. 2 is a plot of solids deposition from a natural gas sample as a function of pressure for four different temperatures.

FIG. 2 shows the quantity of solids collected at 160° F., 180° F., 200° F., and 220° F. between 1,000 and 2,200 psig from a flowing gas well. The lines are smooth curves drawn by "eyeball" through the data points. From the graph, the pressure at which solids will begin to precipitate at each temperature can be ascertained. For example, at 180° F., solids begin to form at about 1,900 psig and increase as the pressure decreases.

Changes and modifications in the specifically described embodiments can be carried out without departing from the scope of the invention which is intended to be limited only by the scope of the appended claims.

We claim:

1. A method for locating a solvent injection apparatus within a natural gas wellbore to reduce the deposition of hydrocarbonaceous solids which are at least partially soluble in the solvent (a) estimating temperature and pressure profiles at flow conditions through the depth of the natural gas wellbore over the production life of the natural gas well;

(b) withdrawing a sample stream from a production natural gas well;

(c) depressuring the withdrawn natural gas sample stream of step (b) to a selected pressure within the natural gas wellbore pressure range estimated in step (a);

(d) providing a solid nonporous surface maintained under conditions of substantially constant temperature selected from the range of estimated natural gas wellbore temperatures determined in step (a);

(e) flowing the depressured natural gas sample of step (c) in contact with the solid nonporous surface of step (d);

(f) measuring the quantity of natural gas contacted by said solid surface; and (g) measuring the quantity of precipitate formed on said solid surface; and (h) establishing a functional relationship defining the rate of precipitate formation as a function of wellbore depth and relative time in said production life of said natural gas well; and (i) locating said solvent injection apparatus within said natural gas wellbore at wellbore depth below that corresponding to precipitate formation rates sufficient to interfere with the production of said natural gas well.

2. A method for locating a solvent injection apparatus within a natural gas wellbore to reduce the deposition of hydrocarbonaceous solids which are at least partially soluble in the solvent comprising the steps of:

(a) estimating temperature and pressure profiles at flow conditions through the depth of the natural gas wellbore over the production life of the natural gas well;

(b) withdrawing a sample stream from a production natural gas well;

(c) depressuring the withdrawn natural gas sample stream of step (b) to a selected pressure within the natural gas wellbore pressure range estimated in step (a);

(d) providing a solid nonporous surface maintained under conditions of substantially constant temperature selected from the range of estimated natural gas wellbore temperatures determined in step (a);

(e) flowing the depressured natural gas sample of step (c) in contact with the solid nonporous surface of step (d);

(f) measuring the quantity of natural gas contacted by said solid surface;

(g) measuring the quantity of precipitate formed on said solid surface;

(h) determining the rate of precipitate formation indicated by said measuring steps (f) and (g), as a function of said pressure of step (c) and said temperature of step (d) for pressure and temperature values within the range defined in step (a);

(i) correlating said rates of precipitate formation of step (h) with wellbore depths of steps (a); and (j) locating said solvent injection apparatus within said wellbore at a depth below that corresponding to conditions of temperature and pressure associated by step (h) with rates of precipitate formation sufficient to interfere with the production of said natural gas well.

3. The process of claim 2 wherein said step (d) for providing a nonporous surface under conditions of substantially constant temperature further comprises providing a sintered metal filter, and wherein step (e) further comprises flowing said depressured natural gas stream through said sintered metal filter.

4. A device for measuring the precipitation of solid hydrocarbonaceous materials from a natural gas stream under selected conditions of temperature and pressure comprising:

(a) a valved sample conduit for withdrawing a sample stream from a production natural gas well;

(b) a pressure control valve in the sample conduit for depressuring the withdrawn natural gas stream to a preselected pressure;

(c) heating means for controlling the temperature of the valved sample conduit and the pressure control valve;

(d) a precipitate collection vessel downstream from the pressure control valve, the precipitate collection vessel being operatively connected to the valved sample conduit;

(e) means for maintaining the precipitate collection vessel at a constant preselected temperature;

(f) a metallic surface within the precipitate collection vessel for collecting hydrocarbonaceous precipitate from the depressured natural gas stream; and (g) a differential pressure indicator connected in parallel with the precipitate collection vessel.

* * * * *